US007945970B2

(12) United States Patent
Belluye et al.

(10) Patent No.: US 7,945,970 B2
(45) Date of Patent: May 24, 2011

(54) TIGHTS PRESENTING A LOCALIZED COMPRESSION EFFECT FOR PRACTICING A SPORT

(75) Inventors: Nicolas Belluye, Lille (FR); Aurélien Bringard, Belfort (FR); Grégory Bayart, Mouvaux (FR)

(73) Assignee: Decathlon, Villeneuve d'Ascq (FR)

( * ) Notice: Subject to any disclaimer, the term of this patent is extended or adjusted under 35 U.S.C. 154(b) by 778 days.

(21) Appl. No.: 11/298,449

(22) Filed: Dec. 12, 2005

(65) Prior Publication Data

US 2006/0169004 A1 Aug. 3, 2006

(30) Foreign Application Priority Data

Dec. 24, 2004 (FR) ..... 04 13925
Sep. 9, 2005 (FR) ..... 05 09227

(51) Int. Cl.
*A41D 13/00* (2006.01)
*A41D 1/06* (2006.01)

(52) U.S. Cl. ..... 2/69; 2/227

(58) Field of Classification Search ..... 2/227, 69
See application file for complete search history.

(56) References Cited

U.S. PATENT DOCUMENTS 4,089,064 A * 5/1978 Chandler, Jr. ..... 2/78.2
4,625,336 A 12/1986 Derderian
4,862,523 A * 9/1989 Lipov ..... 2/409
4,946,453 A * 8/1990 Monson ..... 604/312
5,046,194 A * 9/1991 Alaniz et al. ..... 2/69
5,201,074 A * 4/1993 Dicker ..... 2/70
5,282,277 A * 2/1994 Onozawa ..... 2/69
5,367,708 A * 11/1994 Fujimoto ..... 2/22
5,608,913 A * 3/1997 Lacoste ..... 2/115
5,640,714 A * 6/1997 Tanaka ..... 2/22
5,737,773 A * 4/1998 Dicker et al. ..... 2/69
5,768,703 A * 6/1998 Machado et al. ..... 2/2.15
5,829,058 A * 11/1998 Dicker et al. ..... 2/69
5,867,826 A * 2/1999 Wilkinson ..... 2/69
5,925,010 A * 7/1999 Caprio, Jr. ..... 602/62
5,937,441 A * 8/1999 Raines ..... 2/69
5,960,474 A * 10/1999 Dicker et al. ..... 2/69

(Continued)

FOREIGN PATENT DOCUMENTS

EP 0 519 135 A 12/1992

(Continued)

OTHER PUBLICATIONS

Patent Abstracts of Japan, vol. 2000, No. 25, Apr. 12, 2001 & JP 2001 214303 A (Wacoal Corp; Sasada Medias KK), Aug. 7, 2001.

*Primary Examiner* — Alissa L Hoey
(74) *Attorney, Agent, or Firm* — Kenyon & Kenyon LLP

(57) ABSTRACT

Tights having a localized compression effect for practicing a sport in which the legs are moved repetitively, in particular running or cycling, are constituted by stretchable textile pieces assembled to one another, namely first pieces having normal elasticity, second pieces providing a compression effect, and optionally third pieces having greater elasticity. When assembled together, all of the first and second pieces present substantially the same mean elasticity in the longitudinal direction of the tights, while the second pieces present, in the transverse direction, mean elasticity that is less than half the mean elasticity of the first pieces. Preferably, the difference in mean elasticity in the transverse direction between the first pieces and second pieces presenting the compression effect presents a ratio lying in the range 2 to 3.

12 Claims, 5 Drawing Sheets

U.S. PATENT DOCUMENTS

| | | | | |
|---|---|---|---|---|
| 6,047,406 | A * | 4/2000 | Dicker et al. | 2/69 |
| 6,186,970 | B1 * | 2/2001 | Fujii et al. | 602/75 |
| 6,231,488 | B1 * | 5/2001 | Dicker et al. | 482/124 |
| 6,243,879 | B1 * | 6/2001 | Lyden | 2/227 |
| 6,279,161 | B1 * | 8/2001 | Johnston | 2/69 |
| 6,332,221 | B1 * | 12/2001 | Gracey | 2/69 |
| 6,438,755 | B1 * | 8/2002 | MacDonald et al. | 2/69 |
| 6,446,264 | B2 * | 9/2002 | Fairhurst et al. | 2/69 |
| D465,315 | S * | 11/2002 | Tanaka | D2/742 |
| D465,900 | S * | 11/2002 | Tanaka | D2/742 |
| 6,874,337 | B2 * | 4/2005 | Uno et al. | 66/177 |
| D505,769 | S * | 6/2005 | Ota et al. | D2/731 |
| 6,918,140 | B1 * | 7/2005 | Cooper | 2/228 |
| D512,812 | S * | 12/2005 | Ota et al. | D2/731 |
| D513,830 | S * | 1/2006 | Ota et al. | D2/731 |
| D517,279 | S * | 3/2006 | Fujii | D2/731 |
| 7,074,204 | B2 * | 7/2006 | Fujii et al. | 602/75 |
| 7,117,537 | B2 * | 10/2006 | Mazzarolo | 2/69 |
| 7,229,390 | B2 * | 6/2007 | Fujii et al. | 482/124 |
| 7,260,961 | B1 * | 8/2007 | Kennedy | 66/177 |
| 7,500,274 | B1 * | 3/2009 | Kallen | 2/227 |
| 7,516,498 | B2 * | 4/2009 | Torry | 2/69 |
| 2001/0014981 | A1 * | 8/2001 | Fairhurst et al. | 2/69 |
| 2003/0101506 | A1 * | 6/2003 | Fujii et al. | 2/240 |
| 2004/0078865 | A1 * | 4/2004 | Culhane | 2/69 |
| 2004/0107479 | A1 * | 6/2004 | Dicker et al. | 2/227 |
| 2004/0111781 | A1 * | 6/2004 | Miyake et al. | 2/69 |
| 2004/0255358 | A1 * | 12/2004 | Ota et al. | 2/69 |
| 2005/0086721 | A1 * | 4/2005 | Lambertz | 2/69 |
| 2005/0193461 | A1 * | 9/2005 | Caillibotte et al. | 2/69 |
| 2005/0210559 | A1 * | 9/2005 | Gabriele | 2/69 |
| 2005/0241044 | A1 * | 11/2005 | Zorica | 2/69 |

FOREIGN PATENT DOCUMENTS

| | | | |
|---|---|---|---|
| FR | 2 184 543 | A | 12/1973 |
| FR | 2 833 467 | A | 6/2003 |
| WO | WO 02/064073 | A1 | 8/2002 |

* cited by examiner

TIGHTS PRESENTING A LOCALIZED COMPRESSION EFFECT FOR PRACTICING A SPORT

The present invention relates to tights, i.e. to a garment covering at least the bottom portion of the body, from the waist down to the ankles, and possibly also part of the top portion of the body. The invention relates more particularly to tights having localized zones that present a compression effect and that are specially designed for practicing a sport in which the legs move repetitively, in particular running or cycling.

BACKGROUND OF THE INVENTION

Compression is well known in the medical field, and usually applies to elastic stockings or socks. Those are textile articles made of an elastic material, e.g. from elastane yarns, knitted in such a manner as to enable a compression effect to be exerted that varies from one covered zone to another, specifically between the ankle, the calf, or even the thigh. Elastic stockings or socks are recommended when there is a need to improve circulation of the blood.

In the field of sports, it is known to apply a compressive effect by a so-called "strapping" technique consisting in winding an elastic bandage around a joint in order to stabilize it. By extension, this strapping technique is also applied to holding muscular masses, e.g. around the thigh.

All kinds of garments have already been proposed for covering various portions of the body while presenting a localized compression effect, with compression acting on certain precise zones only, said compression being suitable for conferring one or other of the advantages expected of compression, namely: improving circulation of the blood; lymphatic drainage; proprioception; holding muscular masses; and/or stabilizing joints.

In general, such garments are constituted by a basic support having a compression strip fitted thereto, at least locally. The basic support presents normal elasticity and does not produce a compression effect. The compressive strip presents less elasticity so that while the garment is being worn it produces the looked-for localized compressive effect. The compression strip may be made out of a textile piece made of a material presenting lower elasticity than the basic support and applied thereto e.g. by adhesive or by stitching. It may also be constituted by localized treatment of the basic support using an impregnating agent that modifies the elasticity of the basic support in the impregnated zone.

Such garments are known in particular from documents WO 91/01704 and EP 0 519 135.

The present invention relates more particularly to a garment constituted by a pair of tights specially designed for practicing a sport in which the legs perform repetitive movements, in particular running and cycling, the garment presenting a localized compression effect, in particular for the purpose of supporting muscular masses and for holding the knee joints.

Running, whether long or middle distance running or mountain running or trekking, leads the leg to repeating the same movements, with the muscles and joints working in the same manner on each stride. The essential quality of a garment that is specially designed for running is to avoid impeding the athlete and above all to avoid giving rise to any mechanical stress that could be an additional source of effort and fatigue. The same applies to cycling.

According to the Applicant, applying the techniques recommended in documents WO 91/01704 and EP 0 519 135 to tights for performing such sports, so as to prepare garments with localized compression, necessarily leads to a pair of tights that does not present this essential quality, but on the contrary presents the drawback of leading to mechanical stress that is a source of discomfort and fatigue for the athlete.

OBJECTS AND SUMMARY OF THE INVENTION

The present invention seeks to mitigate that drawback by proposing tights presenting a localized compression effect, constituted by stretchable textile pieces that are assembled to one another, namely first pieces having normal elasticity and second pieces presenting a compression effect, and optionally third pieces having greater elasticity. Furthermore, all of the first and second pieces, when assembled together, present substantially the same mean elasticity in the longitudinal direction of the tights, while the second pieces present, in the transverse direction, mean elasticity that is less than half the elasticity of the first pieces.

Thus, according to the particular provisions of the present invention, the tights present substantially the same elasticity over their full height in the longitudinal direction, i.e. in the long direction of the legs; with this "mean" elasticity being selected so as to avoid giving rise to discomfort or mechanical during the repetitive movements of the athlete's legs. As a result, the presence of second pieces presenting a compression effect does nothing to spoil the elasticity of the tights in the longitudinal direction, unlike that which occurs when compression zones are constituted by strips that are applied to a basic support or that are obtained by impregnating the basic support with a treatment agent that locally modifies its elasticity, as is the case for the above-mentioned documents.

A concept of mean elasticity takes account of the normal variations in the mechanical properties of any textile manufacture, which variations stem from differences due in particular to the origins of the raw materials, to weaving or knitting conditions, and to the adjustments of the machinery.

The positive and negative variations from a mean value may be of the order of 5% to 10%, and sometimes even more.

In the present invention, the compression effect is obtained solely by the elasticity difference presented by the second pieces in the transverse direction of the tights. Preferably, the difference in mean elasticity in the transverse direction between the first pieces and the second pieces presenting a compression effect lies in a ratio of 2 to 3.

For example, the mean elasticities in the longitudinal direction of both the first and the second pieces can be respectively 100% and 97%, whereas their mean elasticities in the transverse direction are respectively 130% and 50%.

In a variant embodiment, the first and second pieces are of the woven type with warp yarns and/or of the knitted type with columns of stitches, and the warp yarns and/or the columns of stitches all extend in the same direction in the made-up garment. It will be understood that complying with this provision requires make up to be particularly accurate, but that is the cost of achieving the looked-for effect for tights of the present invention.

Preferably, the pieces are assembled together by flatlock or whipstitch type stitching, advantageously making use of crimped type yarn and with the tension of the stitching yarn being adjusted to values that are lower than those normally used for stitching so as to ensure that the presence of the stitching does not lead to non-uniformity in the mean elasticities, in particular in the longitudinal direction of the assembled pieces.

In a preferred variant, the first and second pieces are assembled around the knee in a arcuate manner so as to present a flexing angle that corresponds to an intermediate position taken by the leg during its repetitive movements. For tights for running, this angle is 20° to 25°, in particular about 20° for tights for mountain running. Furthermore, under such circumstances, the tights should include a third piece of greater elasticity at the back of the knee. For tights for cycling, the flexing angle if about 30°. The fact of the tights adopting this middle configuration on being made up serves to limit the forces involved during the flexion and extension movements of the legs, it being understood that when standing still, there is already a flexing angle of about 10° at the knee. This particular provision firstly does not impede extension of the leg, and secondly limits the wrinkles that might otherwise form at the back of the knee during flexing.

The piece of greater elasticity optionally situated over the back of the knee serves during extension of the knee to absorb the difference in dimensioning due to the fitted make up without leading to additional elongation forces.

By way of example, this third piece of greater elasticity is a mesh-net textile. Such a net presents great permeability to air, thus enabling an additional ventilation effect to be obtained.

In a variant embodiment, at least a first piece has at least one mock seam creating a line of smaller elasticity, said line extending between two second pieces, obliquely relative to the longitudinal direction. This mock seam prevents any possibility of two second pieces moving apart, away from their normal position, as could arise due to a change in the distribution of volumes inside the tights while the muscles are working.

In a variant embodiment, a second piece presenting a compression effect is placed in the portion of the tights at the calf that is to cover the medial and lateral triceps muscles and the lower medial portion of the calf.

In a variant embodiment, the second piece presenting a compression effect is disposed in the portion of the tights at the calf that is to cover the anterior tibia muscle.

In a variant embodiment, a second piece presenting a compression effect is disposed in the portion of the tights around the knee joint that is to cover the medial and lateral ligaments, the anterior tubercle of the tibia, the patella ligament, and all the anterior portion of the knee joint.

The patella is preferably covered by a first piece or possibly by a third piece, said first or third piece having a configuration, for example, that is substantially circular, oblong, or rectangular, with top and bottom sides presenting convex curvature.

In a variant embodiment, a V-shaped second piece is placed in a portion of the tights so that the limbs of the V-shape cover firstly the anterior portion of the knee joint at the base of the V-shape, and secondly the anterior base of the thigh. The first limb of the V-shape covers the lateral great muscle (vastus lateralis) and the tensor muscle of the fascia lata (tensor fasciae latae) so as to terminate on the antero-superior iliac spine at the waistband of the tights. The second limb of the V-shape covers the medial great muscle (vastus medialis) and the adductor muscle group.

In a variant embodiment, a second piece presenting a compression effect is placed in the portion of the tights that is to cover the rear portion of the hamstring muscle group from the high lateral portion to the low medial portion.

In a variant embodiment, a second piece presenting a compression effect is placed in the front portion of the tights for covering the abdomen, in the form of a transverse strip with a central portion of greater vertical extent than its two lateral portions.

In a variant embodiment, a second piece presenting a compression effect is placed in the form of a transverse strip in the rear portion of the tights for covering the lower back, over the greatest gluteal muscles. Under such circumstances, a third piece constituted by an open-mesh net is preferably placed over said second piece, at the waist, in order to obtain better evacuation of sweat.

In a variant embodiment, a third piece of greater elasticity is disposed in the portion of the tights that is to cover the crutch zone, starting along the gluteal fold and joining the medial tubercle of the femur.

BRIEF DESCRIPTION OF THE DRAWINGS

The present invention can be better understood on reading the following description of three preferred embodiments of tights, the first specially designed for long and middle distance running, the second for mountain racing or "trekking", and the third for cycling, these garments presenting localized elasticated compression effect zones, and being shown in the accompanying drawings, in which.

MORE DETAILED DESCRIPTION

The tights of the present invention are intended mainly for athletes performing a sport during which the legs move in repetitive manner, in particular middle and long distance running, mountain running, or cycling.

At least in the portion for covering the lower part of the body, from the waist to both ankles, the tights are constituted by assembling together three types of pieces, using a sewing technique that limits or eliminates any risk of non-uniformity of elasticity between assembled-together pieces, as explained below. The edges of the assembled pieces are juxtaposed without being superposed.

The pieces referred to below as "first" pieces are cut from an elastic textile material of normal elasticity. For example it could be a non-run "locknit" fabric weighing about 170 grams per square meter (g/m$^2$) and made of 80/20 polyamide-elasthane yarn.

Such a knit presents mean elasticity in the longitudinal direction, along the columns of stitches, leading to an elastic elongation of 100%, and in the transverse direction leading to elastic elongation of 130%.

The pieces referred to below as "second" pieces are cut from an elastic textile material of elasticity in the transverse direction that is much less than that of the first pieces by a factor of at least 2 and preferably lying in the range 2 to 3. This material provides compression greater than 7 mmHg.

In an embodiment, it comprises a non-run fabric with a reversed locknit, weighing about 240 g/m$^2$, and made up of 80/20 polyamide microfibers and elastane yarn.

To measure the mean elasticity, elongation is calculated under a force of 15 newtons (N). In the above examples, the mean elasticities in the longitudinal direction of the first and second pieces of the tights are practically identical, with a difference of less than 5%, whereas their mean elasticities in the transverse direction differ in a ratio of 2.5.

Pieces, referred to below as "third" pieces, are pieces of mean elasticity that is greater than that of the first pieces. They are constituted in particular by a net of relatively open mesh, also serving to provide a ventilation effect in the zones they cover.

Figure 1:
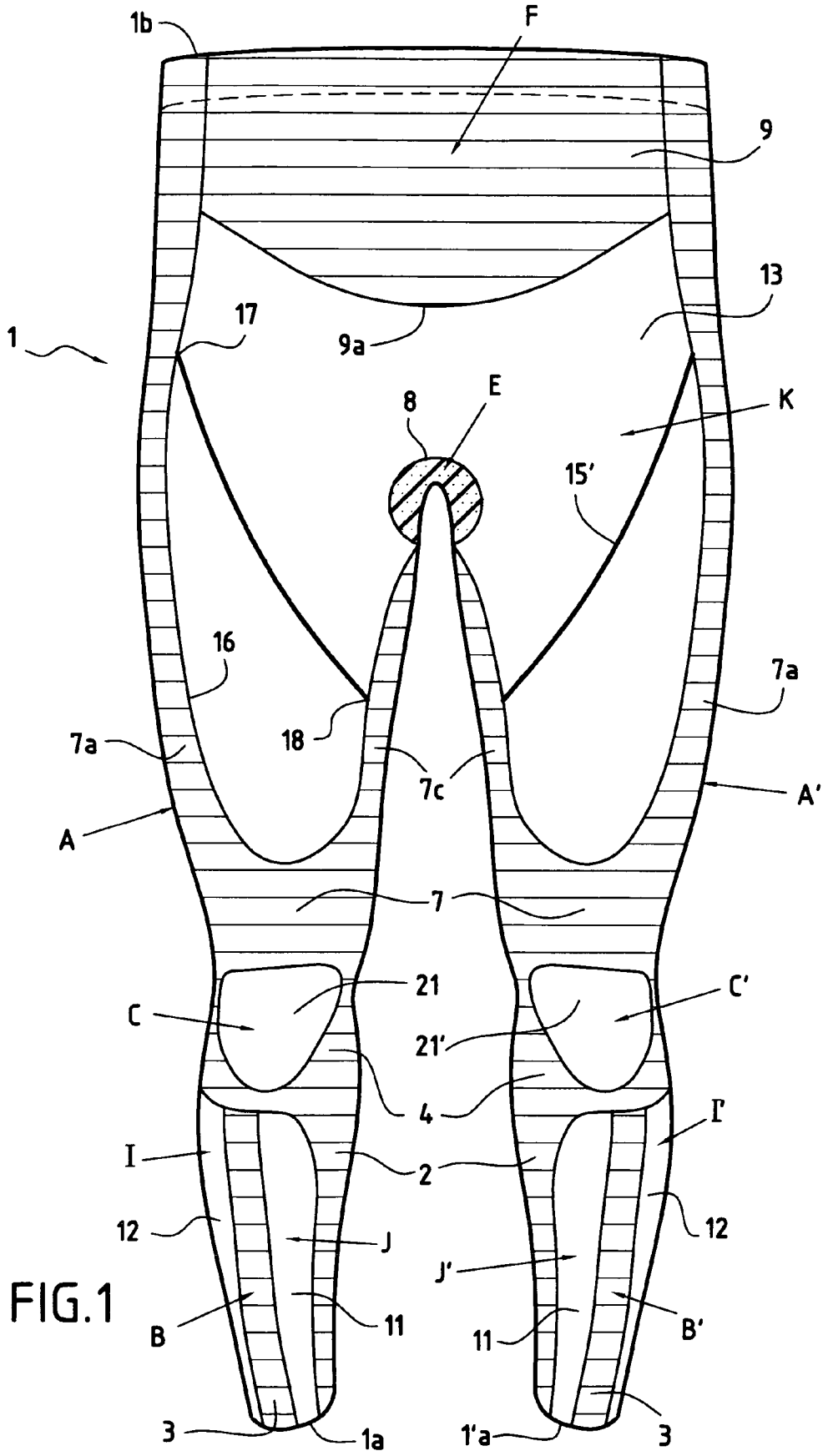
FIGS. 1 to 3 corresponding to the first embodiment seen from the front in FIG. 1, from behind in FIG. 2, and from the side in FIG. 3.
Figure 2:
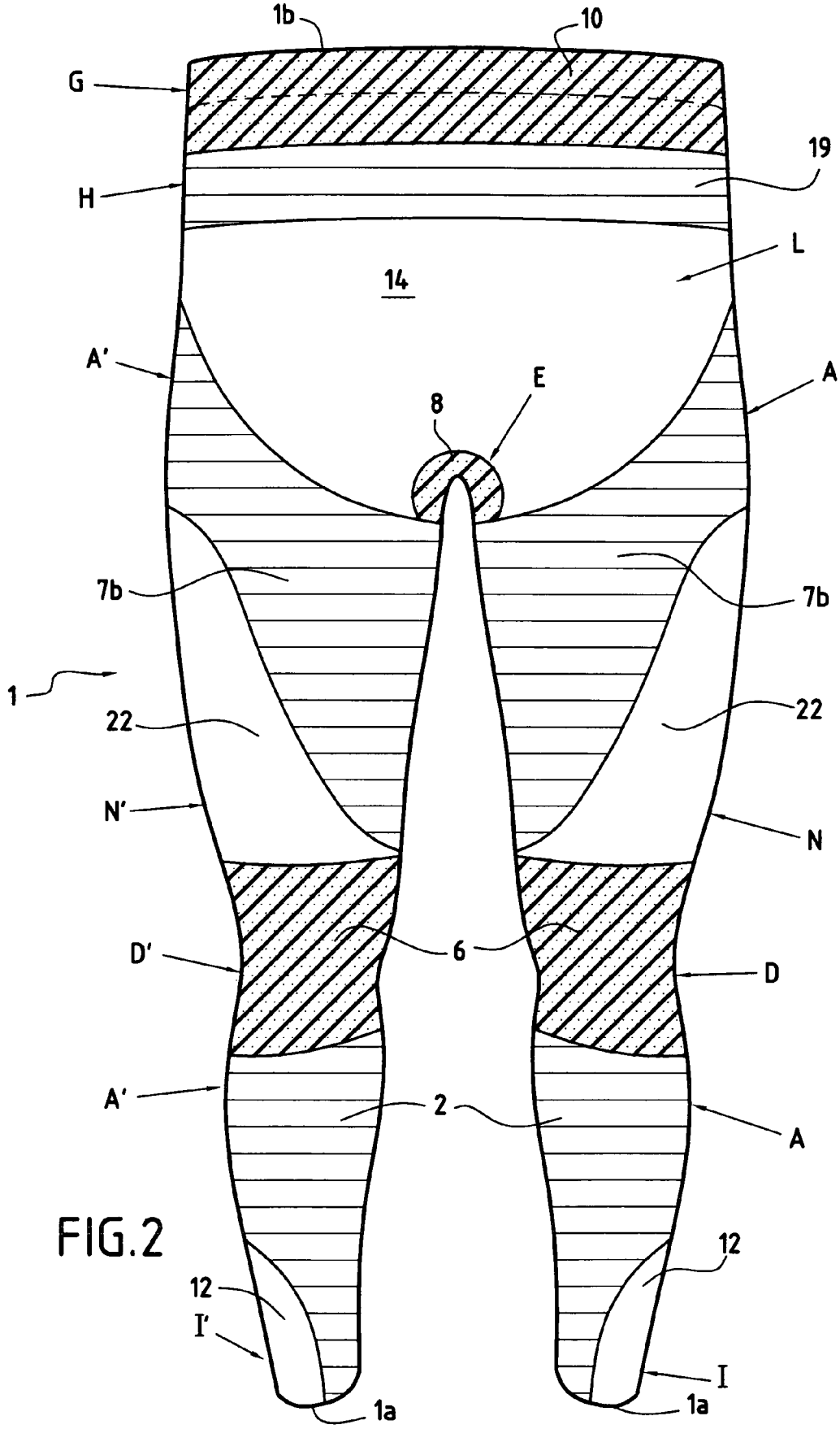
Figure 3:
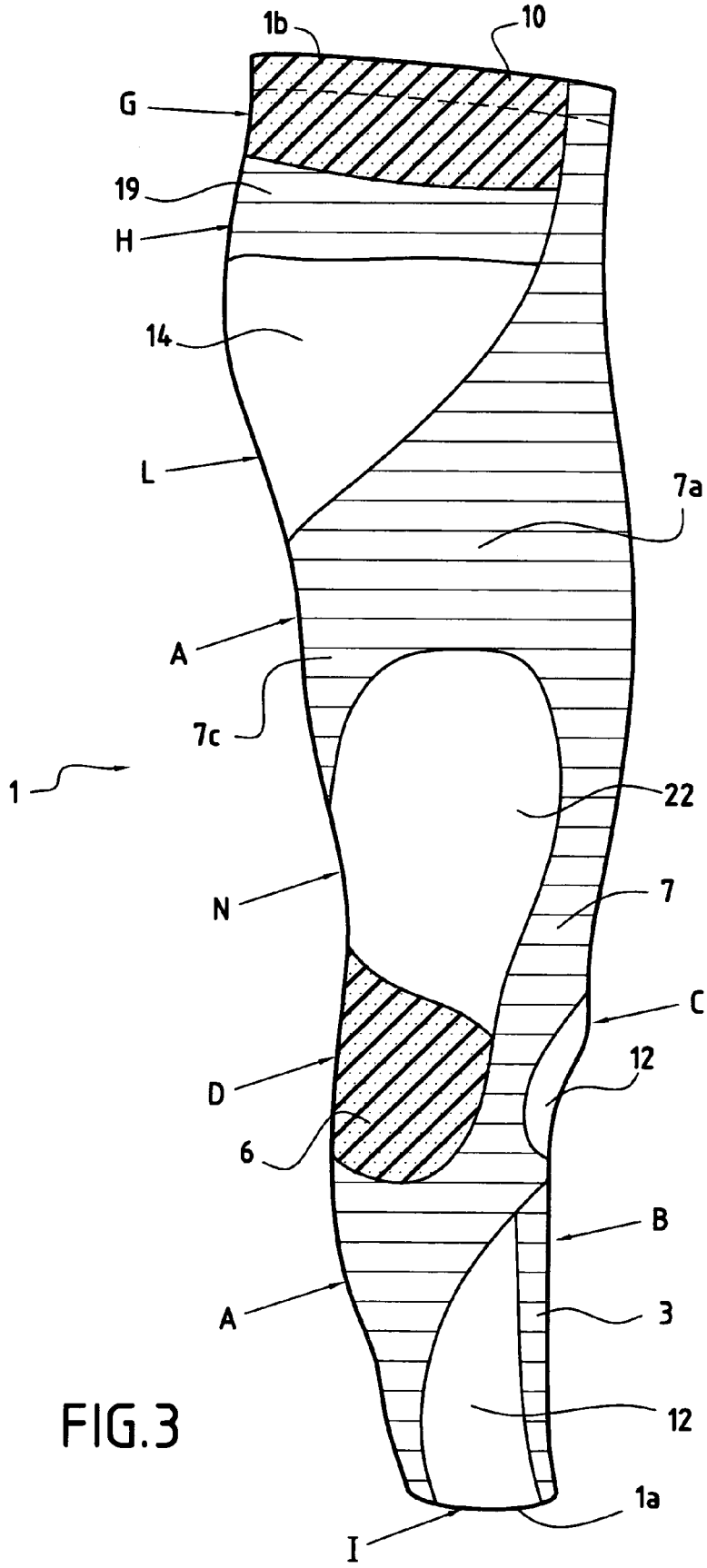

In the first example shown in FIGS. 1 to 3, the pair of men's tights 1 is intended for middle and long distance runners. It is made up of an assembly of eighteen panels comprising eight panels (C, C', I, J, K, L, N, N') having the structure of first pieces of normal elasticity, six second panels (A, A', B, B', F, H) having the structure of second pieces providing a compression effect, of transverse elasticity that is smaller than that of the first pieces, and four third panels (D, D', E, G) having the structure of third pieces, made of an open-mesh net. In the figures, the first panels are drawn without shading, the second panels have horizontal shading, and the third panels have diagonal shading.

The assembly is implemented in such a manner that all of the columns of stitches in the first and second assembled-together pieces extend in the same direction corresponding to the longitudinal direction of the pair of tights, i.e. the vertical direction when the tights are worn by a user standing upright.

In addition, assembly is made in arcuate manner at each knee joint for a flexing angle of said knee of about 20° to about 25°.

Assembly is performed by flatlock or whipstitch type sewing, using crimped yarn, e.g. textured yarn, on a framer. It is desirable to adjust the tension of the sewing machine yarn to a value lower than that commonly used, in order to limit the negative effect that the presence of stitches might have on the uniformity of the mean elasticities of the assembled-together pieces, in particular in the longitudinal direction.

The distribution of the various panels making up the tights and the zones they cover on the runner's body are described below with reference to FIGS. 1 to 3.

It should be understood that the number of panels used in making the tights could be different, particularly between men's and women's tights, and that what matters is not the number of panels but the way in which the first, second, and third pieces are distributed over the parts of the body covered by the tights. In the description below, the term "panel" is used to specify the embodiment shown in the figures and the terms "first", "second", and "third" pieces to specify their localized dispositions over zones of the body.

In the bottom portion of the leg, corresponding to the calf, a second piece 2 covers the medial and lateral triceps muscles (gastroncnemius medialis and gastrocnemius lateralis) and also the bottom medial portion of the calf. More precisely, this second piece 2 covers the entire medial portion of the calf starting along the medial edge of the tibia (margo medialis) between the base of the medial tubercle of the tibia (condylus medialis) and coming to an end above the medial malleolus (malleolus medialis), running along the medial edge of the tibia. This second piece is extended to the middle of the rear face of the calf, in line with the Achilles tendon, so that it bottom portion covers the upper portion of the lateral triceps muscle, following the anatomical outline of the belly of this muscle in its lower lateral portion. This second piece 2 is thus asymmetrical since starting from a horizontal line intersecting the triceps muscles at the base of the medial tubercle of the tibia it goes to the bottom la of the leg of the garment for its medial portion, whereas it terminates beneath the medial triceps muscle for its lateral portion, following the curve formed by the belly of this muscle for the low lateral portion. One of these second pieces 2 forms a part of each of the two panels A, A'.

Another second piece 3 covers the anterior tibial muscle. This second piece 3 is defined by the crest of the tibia (margo anterior) and a vertical line passing by the lateral malleolus and the head of the fibula. This second piece 3 extends towards the knee. This second piece 3 corresponds to the panels B, B' which terminate downwards at the bottoms 1*a* and 1'*a* of the tights 1 and extend in their upper portions up to the panels A, A'.

In the portion of the body corresponding to a knee, a second piece 4 covers the medial ligament of the knee (ligamentum collateral tibiale) and the lateral ligament of the knee (ligamentum collateral tibiale), the anterior tubercle of the tibia (tuberositas tibiae), the support of the kneecap (ligamentum patellae), and the entire anterior portion of the knee joint. In the example shown in the figures, one of these second pieces 4 forms a part of each of the panels A, A'.

The kneecap (patella) is covered either by a first piece 5, as shown in FIG. 1, or possibly by a third piece, depending on the climatic conditions in which it is expected the tights will be used. One of these first pieces constitutes each of the panels C and C'. It may be of circular configuration, or oblong or rectangular with its top and bottom sides having convex curvature.

At the back of the knee, a third piece 6 covers the entire popliteal zone (fossa poplitea) and terminates in its top portion in a horizontal line located about 5 centimeters (cm) above the top portion of the medial and lateral tubercles of the femur (epicondylus medialis and epicondylus lateralis). Each of these third pieces 6 corresponds to one of the panels D and D'.

Over the portion of the body corresponding to the thigh, a first piece 7 covers the anterior face of the knee and extends over the thigh, forming a V-shape on its anterior face. The first limb 7*a* of the V-shape covers the lateral great muscle (vastus lateralis) and the tensor muscle of the fascia lata (tensor fasciae latae) in order to terminate on the anterior-superior iliac spine (spina iliaca anterior superior) at the waist, corresponding to the top portion 1*b* of the tights 1. This limb 7*a* covers Maissiat's band (tractus iliotibialis) and terminates in its lateral posterior portion by a straight line extending the lateral ligament of the knee, passing via the greater trochanter (trochanter major) and extending to the top portion 1*b*.

An extension 7*b* extends from this limb 7*a* over the rear portion of the thigh, passing over the hamstring muscle group, from the high lateral portion to the low medial portion. In its top portion, this extension 7*b* underlines the gluteal muscles along the gluteal fold. It goes down obliquely from the top-third of the femur towards the medial tubercle of the femur, and its medial portion covers the adductor muscle group.

The V-shaped second piece 7 has a second limb 7*c* which covers the medial great muscle (vastus medialis) and which extends rearwards to meet the extension 7*b* of the first limb 7*a* at the adductors. The connection between this extension 7*b* and the second limb 7*c* is made by assembling the corresponding panel A or A' to itself via vertical stitches passing over the medial tubercle of the femur (epiconydlus medialis). The extension 7*b* and the second limb 7*c* terminate at their top ends 2 cm or 3 cm below the crutch, at the pubic symphysus (symphysis pubica).

The crutch zone is covered by a third piece 8 corresponding to the panel E.

In the zone corresponding to the abdomen, a second piece 9 covers it transversely; its bottom edge presents a V-shaped configuration such that the vertical extent of its center 9*a* is greater than that of each of its sides. This second piece 9 corresponds to the panel F whose top portion corresponds to the top edge 1*b* of the tights 1.

In the portion corresponding to the back, a third piece 10 forms the rear waistband of the tights. It corresponds to the panel G.

Under this third piece 10, there is provided a second piece 19 that extends transversely covering the lower back above the greatest gluteal muscles (gluteus maximus).

In all other zones of the body that are not covered in the manner specified above by second or third pieces, the tights are made up of first pieces, namely: two first pieces 11, 12 on either side of the second piece 3, a first piece 13 over the front faces of the thighs and rising towards the abdomen, a first piece 14 covering the greatest gluteal muscles, a first piece 22 on the rear side of the thigh. These various first pieces correspond respectively to the panels I, I', J, J', K, L, N, and N'.

As can be seen in FIG. 1, two mock seams 15, 15' cross the anterior portions of the two thighs. Each seam 15 connects the seam 16 between the panels A and K from a high point 17 situated at the base of the tensor muscle of the fascia lata to a low point 18 level with medial great muscle. This mock seam 15 has the effect of creating a line of smaller elasticity between these two points 17 and 18 so as to avoid any possible moving apart between the two limbs of the V-shape of the panel A, away from their normal positions, where such movement apart could arise following a change in the distribution of volumes within the tights 1 while the muscles are working.

In the description of the second and third embodiments given below, mention is no longer made specifically of the panels proper, which are to do with assembling the tights while they are being made up, but only of the first, second, and third pieces which are characteristic of the present invention.

Figure 4:
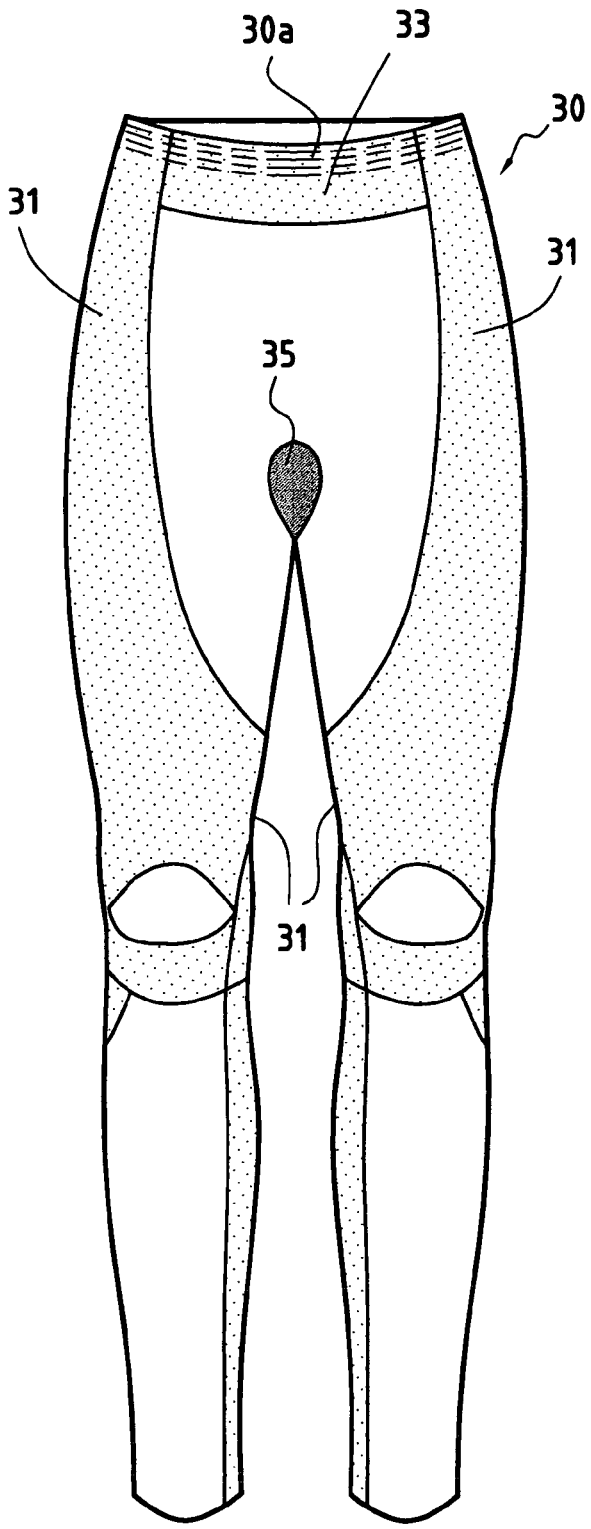
FIGS. 4 and 5 correspond to the second embodiment seen from in front in FIG. 4 and from behind in FIG. 5.
Figure 5:
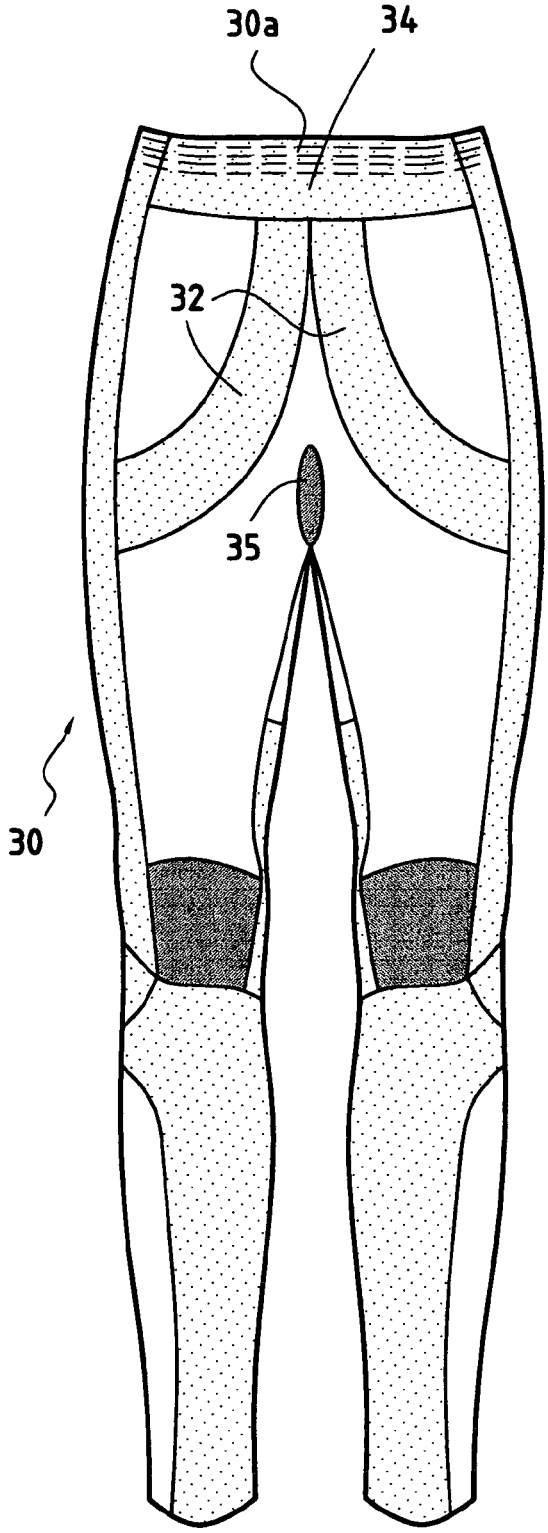

In the second embodiment shown in FIGS. 4 and 5, the tights 30 are for athletes performing mountain running or trekking. The tights are thus likewise tights for running, but nevertheless present certain differences compared with the tights of the first embodiment.

The description below seeks specifically to focus on the differences.

For the bottom portion of the leg, going from the knee zone to the bottom of the tights, the only difference is the omission of the second piece 3 covering the anterior tibial muscle in the tights 1 of the first embodiment. This second piece 3 could also be omitted from the tights 1 for medium or long distance running.

In the portion of the body corresponding to the thigh, a second piece 31 covers the anterior face of the knee and extends over the anterior face of the thigh, covering the lateral great muscle (vastus lateralis) and the tensor muscle of the fascia lata (tensor fasciae latae) so as to terminate at the anterior-superior iliac spine (spina iliaca anterior superior) at the waistband corresponding to the top portion 30*a* of the tights.

This second piece 31 covers Maissiat's band (tractus illotiabilis), and its posterior lateral portion terminates in a straight line extending the lateral ligament of the knee, passing via the greater trochanter (trochanter major) and going to the top portion of the tights.

Another second piece 32 constitutes an extension to the above-mentioned second piece 31, over the posterior face of the thigh, crossing the gluteal muscle group, and in particular the greatest gluteal muscles (gluteus maximus). This second piece 32 starts at the tensor muscle of the fascia lata to terminate in the sacral region level with the lumbo sacral joint.

Mock seams (not shown in FIGS. 4 and 5) can cross the medial and lateral portions of the knee in the corresponding second piece, so as to reduce locally the stretchability of the material, thereby increasing the stability of the joint.

In the zone covering the abdomen, a second piece 33 extends transversely over the abdomen and between the second pieces 31 of the two legs which rise up to the level of the waistband 30*a*. The top portion of this second piece 33 thus likewise forms the waistband. For example it may be about 8 cm high on the sides and about 10 cm high in the middle.

In the portion corresponding to the back, a second piece 34 passes transversely over the lower back above the greatest gluteal muscles (gluteus maximus). It extends transversely between the two second pieces 31 and its top portion forms the waistband.

The various panels constituting the tights 30 for mountain running are assembled being made up in fitted manner around each knee joint for a flexing angle of said knee of about 20°.

Figure 7:
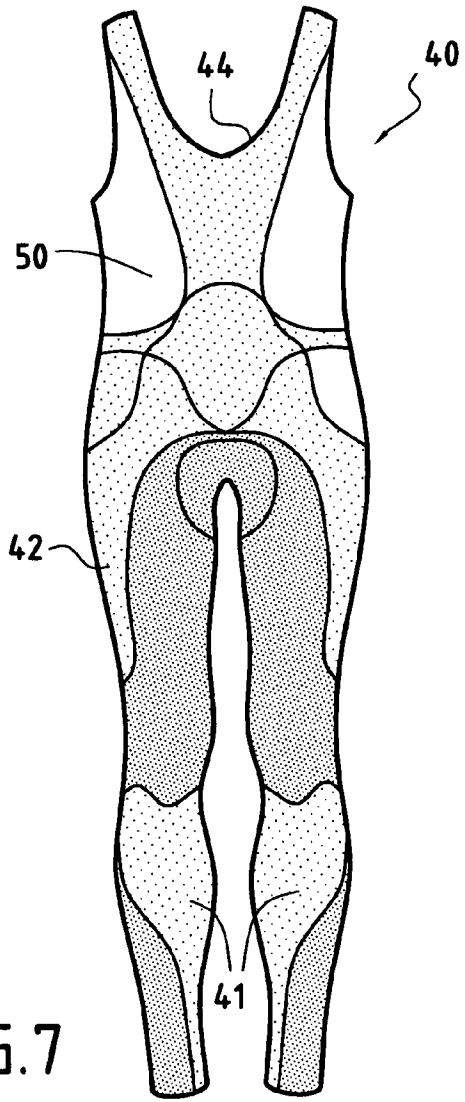
FIGS. 6 to 8 correspond to the third embodiment seen from in front in FIG. 6, from behind in FIG. 7, and from the side in FIG. 8.
Figure 8:
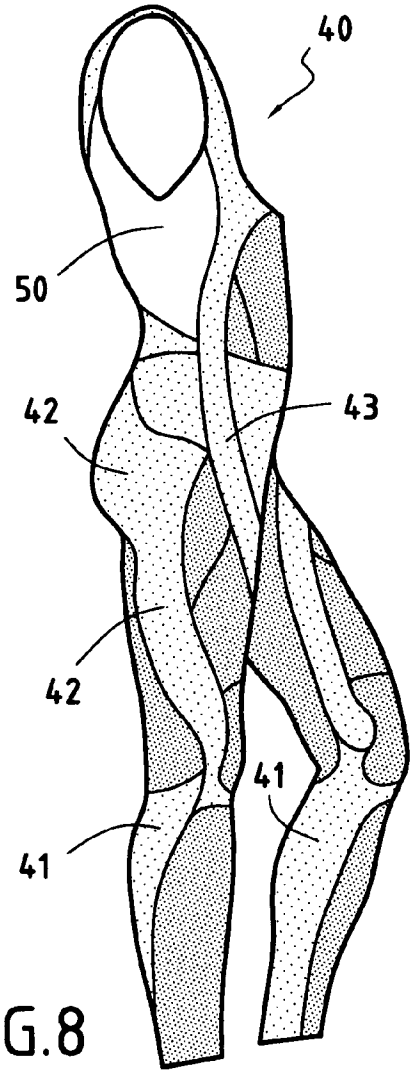
Figure 6:
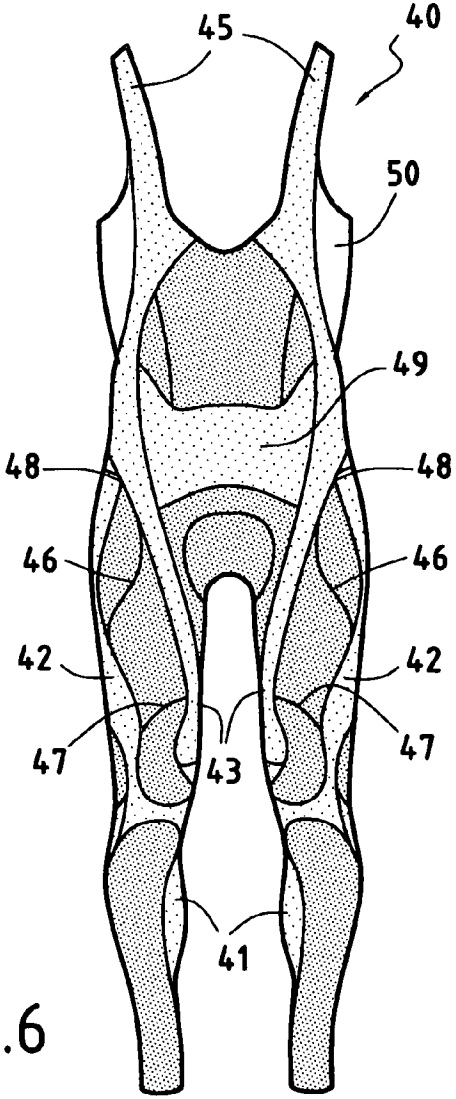

In the third embodiment shown in FIGS. 6 to 8, the tights 40 are intended for cyclists and include a top portion with straps. As for the second embodiment, the description below is detailed only for differences compared with the tights 1 of the first embodiment.

In the bottom portion of the leg, corresponding to the calf, a second piece 41 presents the same characteristics as the second piece 2 of the tights 1 in the first embodiment.

In the portion covering the outside of the thighs and the buttocks, a second piece 42 goes downwards from the back, running along the leg. It covers the lumbo iliocostal muscles (iliocostialis lumbrum), the outside faces of the gluteal muscles (gluteus maximus), the greater trochanter (trochanter major), Maissiat's band (tractus iliotibialis), and the bottom portion of the lateral great muscle (vastus lateralis). This second piece 42 extends downwards over the lateral ligament (ligamentum collaterale fibulare) and the patella ligament (ligamentum patellae). It joins the second piece 41 at the lateral ligament (ligamentum collaterale fibulare) and at the medial ligament (ligamentum collaterale tibiale) and covers the medial ligament (ligamentum collaterale tibiale) to meet the second piece 43 (described below) at the bottom of the medial great muscle (vastus medialis). This second strip 42 has a top portion rising as a central piece in the back along the spinal column and the lumbar muscles in order to form the middle portion 44 of the straps.

In the portion of the body going from the outside of the abdomen to the inside of the thighs, a second strip 43 has a top portion constituted by the front portions of the straps 45, 45'. It is extended downwards in the form of parentheses on either side of the abdomen, covering the lateral portions of the oblique muscles of the abdomen (obliquus externus abdominis and obliquus internus abdominis), the anterior-superior iliac spine (spina iliaca anterior superior), the long sartorium muscle and the medial great muscle (vastus medialis). This second piece 43 terminates between the medial tubercle of the tibia (epicondylus medialis) and the base of the medial great muscle (vastus medialis) where it meets the above-described second piece 42.

Mock seams 46, 47 cross the anterior portion of the thigh between the anterior edges of the two second pieces 42, 43. The first mock seam 46 starts from the second piece 43 about 10 cm below the top junction 48 with the second piece 42 and meets the second piece halfway down the thigh. The second mock seam 47 starts from the second piece 43 halfway down the thigh and meets the second piece 42 a few centimeters above the bottom portion of the lateral great muscle (vastus lateralis). These mock seams 46, 47 prevent the two common edges of said second pieces 42, 43 moving apart when the knee bends.

In the portion covering the abdomen, a second piece 49 passes transversely over the lower abdomen between the second pieces 43 of the two legs. This second piece 49 has a top portion rising to the navel about 10 cm above the pubic symphysus (symphysis pubica). This second piece 49 presents a height of about 15 cm at the sides, and of about 12 cm in its center.

In the portion of the body corresponding to the rib cage, a third piece 50 covers the ribs between the second pieces 42 at the back and 43 at the front. This third piece 50 has a top portion terminating under the arms and a bottom portion joining the second piece 42 a few centimeters above the iliac crest (crista iliaca).

As can be seen from the above description, the straps together with their rear and front portions 44 and 45 are formed by joining together the top portions of the second pieces 42 and 43.

In addition, in the tights 40 for a cyclist, the panels are assembled using a fitted makeup technique around each knee joint for a knee flexing angle of about 30°.

The crutch zone does not have a third piece of greater elasticity, but like any cycling shorts, it includes internal padding, e.g. using chamois leather.

What is claimed is:

1. Tights with a localized compression effect for performing a sport in which the legs are moved with repetitive movements, in particular running or cycling, wherein, in the portion corresponding to the lower part of the body: they are constituted by three types of stretchable textile pieces assembled by sewing to one another, namely first pieces of normal elasticity, second pieces providing a compression effect, and third pieces of greater elasticity; and all of the first and second pieces in the assembly have substantially the same mean elasticity in the longitudinal direction of the tights and the second pieces have mean elasticity in the transverse direction that is less than half the mean elasticity of the first pieces, wherein the compression effect is obtained solely by the elasticity difference presented by the second pieces in the transverse direction, wherein a second piece having a compression effect is disposed in the portion of the tights at the calf for covering the medial and lateral triceps muscles and the lower medial portion of the calf, wherein a second piece having a compression effect is placed in the portion of the tights at the thigh for covering the medial face of the knee and extending over the anterior face of the thigh, and wherein a third piece of greater elasticity is located on the back of the knee and is an open-mesh net.

2. Tights according to claim 1, wherein the difference in mean elasticity in the transverse direction between the first pieces and the second pieces having a compression effect is in a ratio lying in the range 2 to 3.

3. Tights according to claim 1, wherein the first and second pieces are of the woven type with warp yarns and/or of the knitted type with columns of stitches, the warp yarns and/or the columns of stitches all having the same longitudinal direction in the assembly.

4. Tights according to claim 1, wherein at least one first piece or one second piece includes at least one mock seam creating a line of reduced elasticity, disposed obliquely relative to the longitudinal direction.

5. Tights according to claim 1, for long or middle distance running, wherein a second piece having a compression effect is disposed in the portion of the tights at the calf for covering the anterior tibial muscle.

6. Tights according to claim 1, for running, wherein a second piece having a compression effect is placed in the portion of the tights around the knee joint for covering the lateral and medial ligaments, the anterior tubercle of the tibia, the patella ligaments, and all the anterior portion of the knee joint, the patella being covered by a first piece or possibly by a third piece.

7. Tights according to claim 1, for long and middle distance running, wherein a V-shaped second piece is placed in the portion of the tights for covering firstly the anterior portion of the knee joint at the base of the V-shape, and the anterior base of the thigh with the two limbs of the V-shape, the first limb of the V-shape covering the lateral great muscle (vastus lateralis) and the tensor muscle of the fascia lata (tensor fasciae latae) so as to terminate on the antero-superior iliac spine at the waistband of the tights, and the second limb of the V-shape covering the medial great muscle (vastus medialis).

8. Tights according to claim 1, for long and middle distance running, wherein a second piece presenting a compression effect is placed in the portion of the tights that is to cover the rear portion of the hamstring muscle group from the high lateral portion to the low medial portion.

9. Tights according to claim 1, wherein a second piece presenting a compression effect is placed in the front portion of the tights for covering the abdomen, in the form of a transverse strip which, when the tights are for long or middle distance running, presents a central portion of vertical extent that is greater than its two lateral portions.

10. Tights according to claim 1, wherein a second piece presenting a compression effect is placed in the rear portion of the tights for covering the lower back, above the greatest gluteal muscles, in the form of a transverse strip.

11. Tights according to claim 10, for long or middle distance running, wherein a third piece in the form of an open-mesh net is placed over said second piece at the waist.

12. Tights according to claim 1, for running, wherein a third piece of greater elasticity is placed in the portion of the tights for covering the crotch zone, starting along the gluteal fold and joining the medial tubercle of the femur.

* * * * *